US010787011B2

(12) United States Patent
Jorba Closa et al.

(10) Patent No.: US 10,787,011 B2
(45) Date of Patent: Sep. 29, 2020

(54) WIPING PRINT MEDIA

(71) Applicant: Hewlett-Packard Development Company, L.P., Houston, TX (US)

(72) Inventors: Joan Albert Jorba Closa, Sant Cugat del Valles (ES); David Casanova, Sant Cugat del Valles (ES); Carles Flotats Villagrasa, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/569,896

(22) PCT Filed: Jul. 20, 2015

(86) PCT No.: PCT/EP2015/066567

§ 371 (c)(1),
(2) Date: Oct. 27, 2017

(87) PCT Pub. No.: WO2017/012649

PCT Pub. Date: Jan. 26, 2017

(65) Prior Publication Data

US 2018/0104970 A1 Apr. 19, 2018

(51) Int. Cl.
*B41J 2/06* (2006.01)
*B41J 29/17* (2006.01)
(Continued)

(52) U.S. Cl.
CPC ..... *B41J 29/17* (2013.01); *B41J 11/0015* (2013.01); *B41J 29/38* (2013.01)

(58) Field of Classification Search
USPC ..... 347/29, 55
See application file for complete search history.

(56) References Cited

U.S. PATENT DOCUMENTS 4,213,222 A * 7/1980 Schoettle ..... B21C 43/00 15/100
5,421,261 A 6/1995 Stempien
(Continued)

FOREIGN PATENT DOCUMENTS

DE 19609461 10/1996
EP 0622242 11/1994
(Continued)

OTHER PUBLICATIONS

Unknown, "Getting the Best Results with PVC Banners on the HP Latex 3000", (Research Paper), Jan. 17, 2014, 8pages, Hewlett-Packard Development Company, L.P.

*Primary Examiner* — Lam S Nguyen
(74) *Attorney, Agent, or Firm* — HP Inc. Patent Department

(57) ABSTRACT

An example printing apparatus is described comprising a wiping element before the print zone, for slipping in contact with a print medium and wiping a printing surface of the print medium. An implementation of a wiping roller for wiping the printing surface of a print medium may comprise a rigid core, a layer of elastic material and a driving pinion. An example method for printing is also described, comprising spreading over a larger print medium area, by wiping, amounts of a substance that may migrate through a print medium and that is present on the printing surface of a print medium, before printing on the print medium.

20 Claims, 3 Drawing Sheets

(51) Int. Cl.
*B41J 11/00* (2006.01)
*B41J 29/38* (2006.01)

(56) References Cited

U.S. PATENT DOCUMENTS

| | | | | |
|---|---|---|---|---|
| 5,642,670 | A * | 7/1997 | Takeuchi | B41F 23/002 101/423 |
| 6,030,674 | A | 2/2000 | Onishi et al. | |
| 6,228,926 | B1 | 5/2001 | Golumbic | |
| 6,237,176 | B1 * | 5/2001 | Egoshi | B08B 7/0028 15/102 |
| 6,392,679 | B1 | 5/2002 | Nanami | |
| 6,434,358 | B1 | 8/2002 | Maul et al. | |
| 6,503,977 | B1 | 1/2003 | Branham et al. | |
| 8,679,590 | B2 | 3/2014 | Gordon et al. | |
| 2001/0055047 | A1 * | 12/2001 | Ohsawa | B41C 1/1066 347/55 |
| 2003/0046785 | A1 * | 3/2003 | Shiroki | B41F 35/04 15/256.52 |
| 2009/0058921 | A1 * | 3/2009 | Habashi | B41J 2/16585 347/29 |
| 2010/0189489 | A1 | 7/2010 | Aihara | |
| 2012/0314000 | A1 | 12/2012 | Sarkisian et al. | |
| 2014/0192108 | A1 * | 7/2014 | Horaguchi | B41J 11/007 347/16 |

FOREIGN PATENT DOCUMENTS

| | | |
|---|---|---|
| EP | 1291193 | 3/2003 |
| GB | 2464969 | 5/2010 |
| JP | 2002029080 | 1/2002 |
| JP | 2003211680 | 7/2003 |

* cited by examiner

WIPING PRINT MEDIA

BACKGROUND

Some printing media may contain substances which over time may migrate to the printing surface. This phenomenon may occur for instance when rolled media is exposed to high temperatures, for example, during transportation or storage, or simply when media is stored for some time before use.

For example, print media such as vinyl and PVC banners may contain plasticizers to increase their flexibility, and these additives may tend to migrate to the surface. Other substances that may exhibit a tendency to migrate to the printing surface may be, for example, adhesives or silicones present in adhesive media.

BRIEF DESCRIPTION

Figure 1:
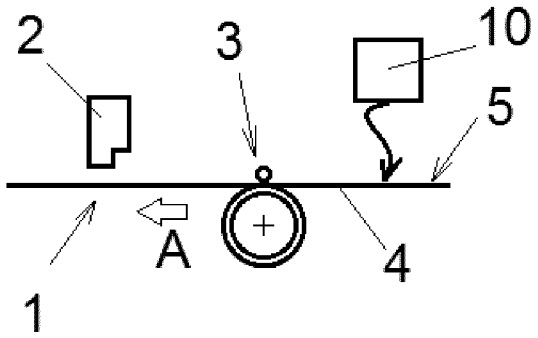
Figure 2:
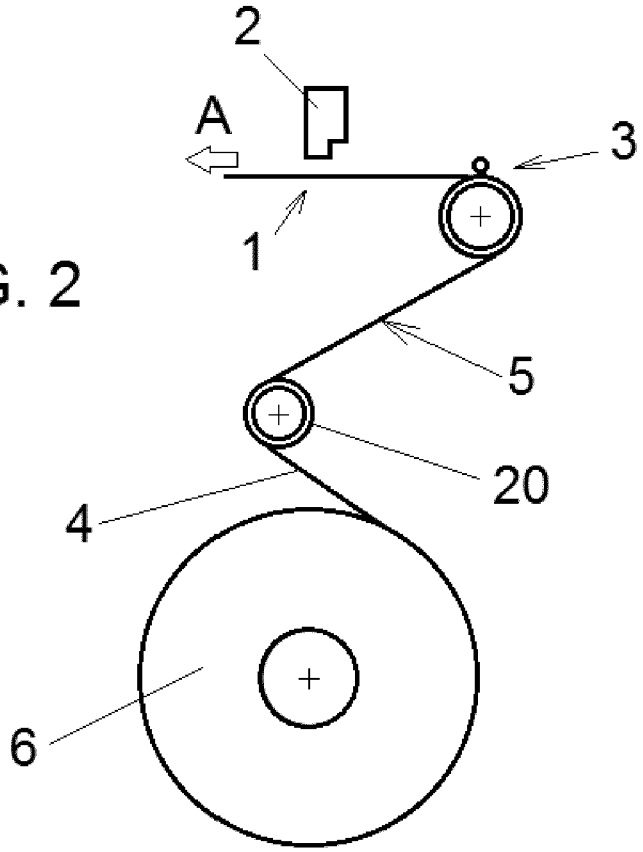
Figure 3A:
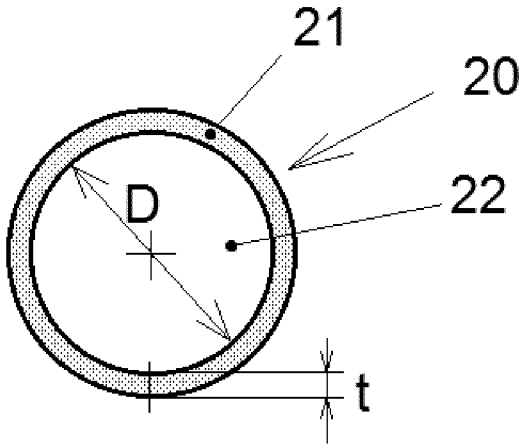
Figure 3B:
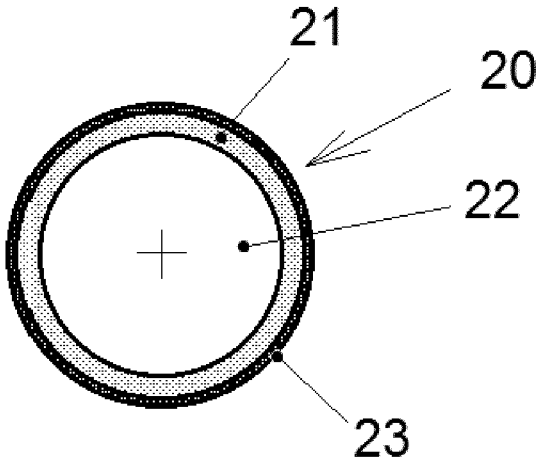
Figure 4:
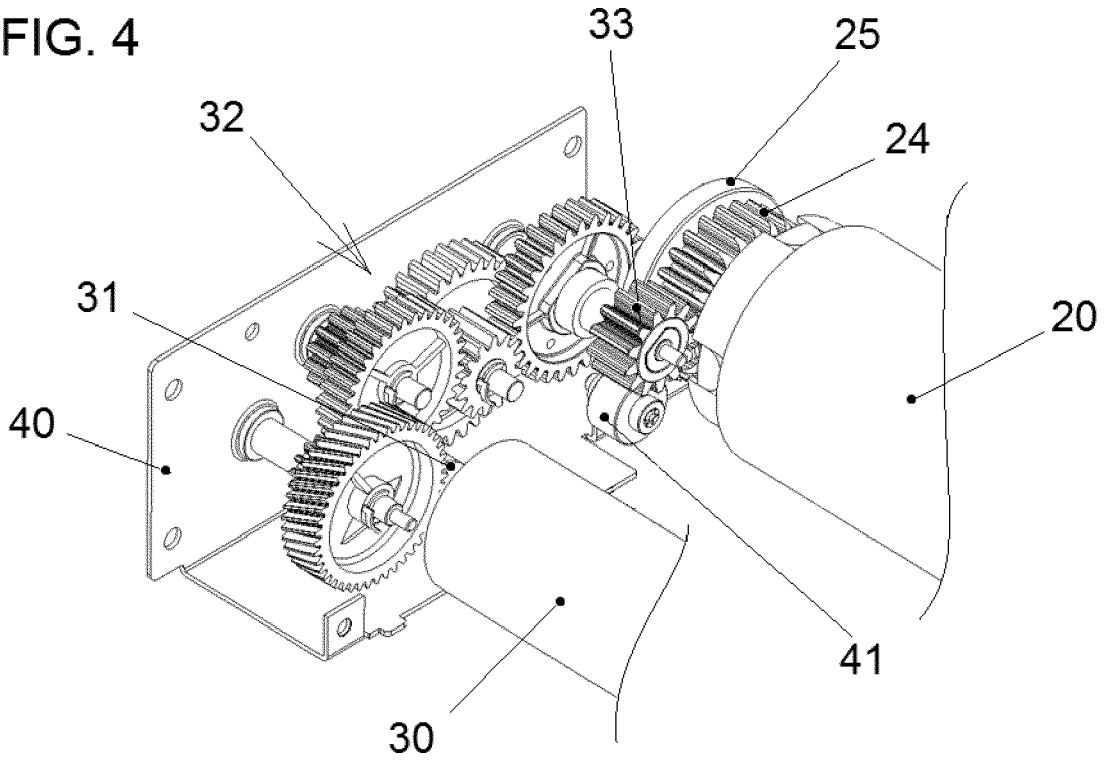
Figure 5:
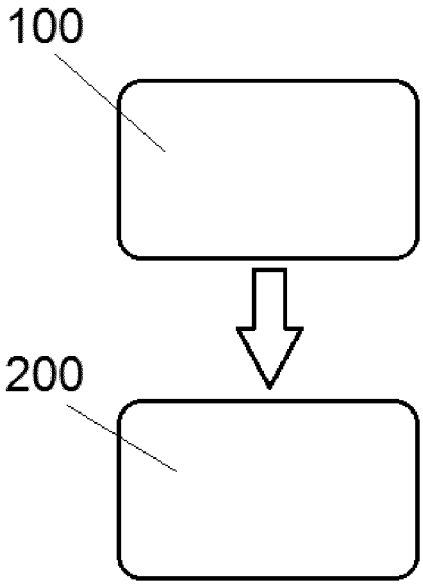

Some non-limiting examples of the present disclosure will be described in the following with reference to the appended drawings, in which:

FIGS. 1 and 2 are schematic diagrams illustrating examples of printing apparatus according to implementations disclosed herein;

FIGS. 3*a* and 3*b* are schematic section views illustrating examples of wiping rollers according to implementations disclosed herein;

FIG. 4 is a schematic perspective view showing examples of the mounting of a wiping roller in apparatus as disclosed herein; and FIG. 5 is a flowchart illustrating examples of a method for printing in accordance with examples disclosed herein.

DETAILED DESCRIPTION

The presence in some printing media of substances, such as plasticizers or adhesives, which over time may migrate to the printing surface forming micro-droplets or random patterns, may affect the quality of printed images.

A substance that has migrated to the printing surface, and/or contaminants present in the form of droplets, micro-droplets or moisture on the surface, may create differences in the surface tension, and it may therefore happen that printing fluid does not deposit uniformly. When printing on such a medium, for example with latex printing fluids, defects such as for example graininess, pinholes or coalescence may appear in the printed image.

In implementations disclosed herein the printing quality may be improved by wiping the printing surface of the media before printing, so as to spread over a larger surface area, i.e. more evenly, substances that may be present on the surface in the form of micro-droplets or the like.

Examples of a printing apparatus as disclosed herein are illustrated in FIG. 1. Example apparatus may comprise a print zone 1 where a printing fluid may be deposited on the printing surface 5 of a print medium 4 from a printhead 2. Input rollers 3 may cause the advance of the print medium 4 towards the print zone 1, in a direction of print media advance shown by arrow A in FIG. 1.

According to examples disclosed herein, a wiping element 10 may be provided in the apparatus before the print zone 1, i.e. upstream of the print zone, in the direction of print media advance A through the apparatus, so that it slips in contact with the print medium 4 when the print medium is advanced towards the print zone 1, thereby wiping the printing surface 5 of the print medium 4 before printing.

By "slip" or "slipping" it is meant herein that the wiping element is in contact with the printing surface of the print medium, and has a different speed from that of the printing surface in the area of contact, such that during operation there is a non-zero relative speed between the wiping element and the printing surface. The relative speed may be caused for example by the wiping element having a higher speed than that of the print medium, or by the wiping element being stationary or having a lower speed than that of the print medium.

The friction caused by wiping may have the effect that substances such as plasticizers that may be present on the printing surface in a non-continuous or uneven distribution, for example in the form of micro-droplets, clots, lumps, or other irregularities, are spread or distributed more evenly. For example, a droplet would be "flattened" on the media and spread over a larger area.

This allows reducing the differences in surface tension between different areas of the print medium and reducing potential defects in the printed image that may be associated with these differences. The quality of the printed image may therefore be improved.

The effect on the printed image of other contaminants present on the surface of the media, for example small amounts of grease from fingerprints due to media handling, may also be reduced.

FIG. 2 shows schematically examples of printing apparatus also comprising a print zone 1, a printhead 2, input rollers 3 to cause the advance of a print medium 4 in a direction of print media advance A. The print medium 4 may be fed from a media roll 6.

In examples such as shown in FIG. 2, the wiping element may be a wiping roller 20 that is provided in the media advance path before the print zone 1 and slips in contact with the printing surface 5 of the print medium 4 to wipe it.

In some examples, the angle through which there is contact between the wiping roller 20 and the print medium 4 is between 10° and 120°.

A wiping roller may have a relatively small contact area with the print medium and still provide a wiping action. Consequently it may be fitted in the media advance path taking up a relatively small space and without affecting the apparatus footprint.

In some examples the back tension of the print medium 4 in the advance path provides a degree of pressure to apply the medium 4 against the wiping roller 20 and maintains the contact between medium and roller. In examples disclosed herein, the back tension may be between 20 and 40 N/m.

In some implementations of printing apparatus as disclosed herein, such as illustrated in FIG. 3*a*, the wiping roller 20 comprises a layer of elastic material 21, for example, attached on a rigid tubular core 22.

The layer of elastic material 21 may be compressed when applied against the print medium, so it may allow maintaining the wiping roller 20 in contact with the printing surface 5 along all the width of the print medium 4 even if there is some degree of misalignment, and therefore may allow relatively uniform wiping, avoiding local defects.

In some examples, dimensions for a wiping roller 20 may be between 50 and 60 mm for the diameter D of the core 22, and between 4 and 10 mm for the thickness t of the layer of elastic material 21.

In some examples, such as illustrated in FIG. 3*b*, the wiping roller 20 comprises a sheath 23 of textile material covering the layer of elastic material 21. The sheath 23 may be made for example of polyester microfiber or suede.

The presence of a sheath 23 may improve the mechanical resistance of the wiping roller 20. Furthermore, maintenance may be simplified by the fact that once the wiping surface becomes affected by wear and/or by having plasticizer or similar substances adhered thereon, as a consequence of use, it is possible to substitute the sheath.

In some implementations of a wiping element such as a wiping roller, both with or without a sheath of textile material, the elastic material may be foam, or a soft rubber. In some examples it may be foam rubber, that is, rubber having an air-filled matrix structure obtained by using a foaming agent. For example, the layer of elastic material 21 may be of polyurethane (PU) foam rubber, which is also wear resistant and compatible with printing fluids.

In some examples of implementations disclosed herein, the maximum compressibility of the layer of elastic material, defined as the maximum compression the material may undergo while remaining elastic, is at least of 50%. With a 50% maximum compressibility, for example, a layer of elastic material with a thickness of 5 mm may undergo a deformation of up to 2.5 mm in a direction perpendicular to the contact surface, for adapting to misalignments of the print medium.

In some examples, implementations of printing apparatus disclosed herein comprise a motor to drive the wiping roller in rotation. FIG. 4 for example shows examples in which a motor 30 with an output shaft 31 is mounted on the frame 40 of the apparatus. In some examples the motor may be for example a DC motor controlled with an encoder (not shown).

In some examples, such as shown in FIG. 4, the wiping roller 20 comprises a driving pinion 24 and the motor 30 drives the wiping roller 20 in rotation through a transmission 32 between the motor output shaft 31 and the driving pinion 24. In an example such as that of FIG. 4 the transmission 32 may be a gear transmission and may comprise a transmission pinion 33 intended to mesh with the driving pinion 24.

Also visible in FIG. 4 is that in some implementations of a printing apparatus with a wiping roller as disclosed herein, the wiping roller 20 may be mounted on a pair of idle support rollers 41 (one visible in FIG. 4). The wiping roller 20 is provided with a cylinder section 25 for resting on the support rollers 41.

In implementations as disclosed herein, a wiping roller 20 for wiping the printing surface of a print medium, for example such as disclosed above in relation to FIGS. 3*a*, 3*b* and 4, may be provided as a kit, or as part of a kit, to be installed in a printing apparatus. The kit may also comprise a driving motor, and may also comprise a transmission.

In some examples, such a wiping roller 20 may comprise as disclosed above a rigid core 22, a layer of elastic material 21 attached to an outer surface of the rigid core, and a driving pinion 24. In some examples it may also comprise a sheath 23 of textile material.

In some implementations it may be foreseen to install a wiping roller 20, for example having a layer of elastic material 21 and a driving pinion 24, in a printing apparatus comprising a motor and transmission, in order to print on some kind of print media such as a vinyl banner, which contain substances that may migrate to the printing surface.

It may also be foreseen in some implementations to remove the wiping roller 20 from the printing apparatus and change it with a plain roller that is not provided with a layer of elastic material or a driving pinion, for example in order to print on other kinds of print media, without prior wiping of the printing surface.

In examples according to some implementations of a printing apparatus, the wiping element 10 (FIG. 1) may be stationary. For example, the wiping element 10 may comprise a wiping surface, flat or curved, against which the print media slips in order to be wiped.

The material of the wiping surface of a wiping element according to examples as disclosed herein may have a dynamic friction coefficient below 0.7 with respect to vinyl print media, in order to avoid affecting the accuracy of the print media advance.

Implementations of a method for printing are illustrated schematically by the flowchart of FIG. 5, and may comprise, in block 100, spreading over a larger print medium area, by wiping, amounts of a substance that may migrate through a print medium and that is present on the printing surface of a print medium, before printing on the print medium in block 200.

In some examples, the wiping operation in block 100 is performed with a wiping roller slipping in contact with the printing surface of the medium, such as examples of a wiping roller 20 as disclosed above. Slipping between the wiping roller and the print medium, and therefore wiping, may occur while the print medium is advancing, but also while it is stationary, for example when printing is performed in swaths on a print medium while stationary, and the print medium is advanced between swaths.

According to some implementations disclosed herein, in block 100 the wiping roller may be rotated, for example employing a motor, in order to cause slipping of the wiping roller with respect to the print medium at least when the print medium is stationary. It may be rotated for example with an angular speed between 20 and 40 rpm.

In some implementations, example methods may involve rotating the wiping roller with an angular speed that causes the relative tangential speed of the surface of the wiping roller with respect to the printing surface of the print medium to be between about 2 in/s and about 5 in/s (between about 50.8 mm/s and about 127 mm/s), for example between about 3 in/s and about 4 in/s (between about 70.6 mm/s and about 101.6 mm/s).

During the wiping operation in block 100, in some examples of the method a tension of the print medium maintains contact between the wiping roller and a printing surface of the print medium.

Some implementations of such methods may be performed by printing apparatus as disclosed above.

In examples of printing operations in which implementations of this disclosure are put in practice, a wiping roller 20 such as shown in FIGS. 2 and 3*a* may be employed. Further features may be for example as follows:

- tubular steel core with an outer diameter D=50 mm
- PU foam rubber layer adhered on the steel core, thickness t=5 mm
- foam rubber layer elastically compressible to 50% of original thickness
- dynamic friction coefficient of the foam material on vinyl media $\mu_k$=0.6
- angle of contact of the wiping roller with the media: 110°
- back tension of the medium: 30 N/m
- speed of rotation of the wiping roller: minimum 30 rpm Although a number of particular implementations and examples have been disclosed herein, further variants and modifications of the disclosed devices and methods are possible. For example, not all the features disclosed herein are included in all the implementations, and implementations comprising other combinations of the features described are also possible.

The invention claimed is:

1. A printing apparatus comprising:

a print zone; and a wiping element before the print zone, in a direction of print media advance through the apparatus, the wiping element comprising a wiping roller having a roller surface, the wiping roller being positioned to contact a printing surface of a printing medium such that the wiping roller both rolls and slips in contact with the print medium, the wiping roller being positioned such that the contact between the wiping roller and surface of the printing medium wiping the printing surface of the print medium to spread substances present on the printing surface of the printing medium over a larger surface area.

2. The apparatus of claim 1, wherein the wiping roller has an angle through which there is direct contact with the printing medium of between 10° and 120°.

3. The apparatus of claim 1, wherein the wiping roller comprises a layer of elastic material.

4. The apparatus of claim 3, wherein the wiping roller comprises a sheath of textile material covering the layer of elastic material.

5. The apparatus of claim 4, wherein the textile comprises polyester microfiber or suede.

6. The apparatus of claim 3, wherein the elastic material is foam rubber.

7. The apparatus of claim 3, wherein the maximum compressibility of the layer of elastic material is at least of 50%.

8. The apparatus of claim 3, wherein the wiping roller comprises a rigid tubular core, the layer of elastic material being arranged on the rigid tubular core.

9. The apparatus of claim 3, wherein the elastic material has a thickness of between 4 and 10 mm.

10. The apparatus of claim 1, comprising a motor to drive the wiping roller in rotation.

11. The apparatus of claim 10, wherein the wiping roller comprises a driving pinion and the apparatus comprises a transmission between the motor and the driving pinion of the wiping roller.

12. The apparatus of claim 1, wherein the wiping element is stationary in the apparatus during wiping of the printing medium.

13. The apparatus of claim 1, wherein the wiping element has a wiping surface having a dynamic friction coefficient, with vinyl print media, below 0.7.

14. The apparatus of claim 1, wherein the wiping roller is mounted on a pair of idle support rollers.

15. The apparatus of claim 1, further comprising a motor to rotate the wiping roller at an angular speed between 20 and 40 rpm.

16. A method for printing, comprising:

contacting a printing surface of a print medium with a wiping element and wiping the printing surface with the wiping element to spread amounts of a substance that may migrate through the print medium and that are present on the printing surface of the print medium over a larger print medium area, before printing on the print medium, the wiping being performed without wetting the wiping element; and, then, outputting the print medium to a print zone and printing on the print medium with a print engine;

wherein the wiping is performed with a wiping roller, the method further comprising both rotating and slipping the wiping roller in contact with the printing surface of the medium to spread the substance.

17. The method of claim 16, comprising rotating the wiping roller with an angular speed such that the relative tangential speed of the surface of the wiping roller with respect to the printing surface of the print medium is between about 2 in/s and about 5 in/s (between about 50.8 mm/s and about 127 mm/s).

18. The method of claim 16, further comprising maintaining contact between the wiping roller and the printing surface of the print medium by applying a tension to the print medium.

19. The apparatus of claim 18, wherein a back tension on the printing medium is between 20 and 40 N/m.

20. The method of claim 16, where the substance comprises a plasticizer or adhesive and the method further comprises spreading the plasticizer or adhesive over the printing surface of the print medium.

* * * * *